United States Patent [19]

Lehnert et al.

[11] Patent Number: 4,811,538

[45] Date of Patent: Mar. 14, 1989

[54] FIRE-RESISTANT DOOR

[75] Inventors: Charles W. Lehnert, Stone Mountain; George F. Fowler, Jr., Norcross, both of Ga.

[73] Assignee: Georgia-Pacific Corporation, Atlanta, Ga.

[21] Appl. No.: 110,321

[22] Filed: Oct. 20, 1987

[51] Int. Cl.[4] ..... E06B 3/70

[52] U.S. Cl. ..... 52/455; 52/232; 52/794; 428/70; 428/703

[58] Field of Search ..... 52/455–459, 52/794, 232; 428/70, 703, 224

[56] References Cited

U.S. PATENT DOCUMENTS

| | | | |
|---|---|---|---|
| 3,196,494 | 7/1965 | Hartman et al. | 428/70 |
| 3,289,371 | 12/1966 | Pearson et al. | 428/703 |
| 3,566,564 | 3/1971 | Gaeth et al. | 52/456 |
| 3,993,822 | 11/1976 | Knauf et al. | 428/703 |
| 4,583,338 | 4/1986 | Sewell et al. | 52/456 |
| 4,647,496 | 3/1987 | Lehnert et al. | 428/484 |
| 4,704,834 | 11/1987 | Turner | 52/456 |

FOREIGN PATENT DOCUMENTS 993779 3/1976 Canada .

*Primary Examiner*—James L. Ridgill, Jr.

*Attorney, Agent, or Firm*—John T. Synnestvedt; Richard D. Weber

[57] ABSTRACT

A fire-resistant door comprises a core panel of mineral material, such as gypsum wallboard. A fiber mat, preferably comprising glass fibers, is at least partially embedded in each face of said core panel. An edge banding assembly disposed around the periphery of the core panel is centrally grooved to receive the panel edges. Facing sheets are affixed to the opposite sides of the edge banding assembly in spaced parallel relation to the core panel, and a spacer material at least partially fills the spaces between the facing sheets and the core panel.

23 Claims, 2 Drawing Sheets

FIRE-RESISTANT DOOR

BACKGROUND OF THE INVENTION

The present invention relates generally to laminated fire-resistant doors and relates more particularly to a fire-resistant door utilizing a central core of mineral faced with a fiber mat, preferably of glass fibers.

Fire doors, as used in residential, commercial and industrial applications, are typically employed in conjunction with fire walls to provide fire protection between different zones of a structure, and particularly to isolate high fire risk areas of a building from the remainder of the structure, such as the garage of a dwelling from its living quarters. Fire doors are usually not capable of indefinitely withstanding the high temperature conditions of a fire but rather are designed to maintain the integrity of the fire wall for a limited time to permit the occupants of a building to escape and to delay the spread of the fire until fire equipment can be brought to the scene.

Various tests have been devised for fire doors and are based on factors such as the time that a given door would withstand a certain temperature while maintaining its integrity, and hose stream tests which involve the door's ability to withstand the forces of a high pressure water stream. The American Society for Testing Materials (ASTM) has devised tests to establish fire door standards and these standards are incorporated into building codes and architectural specifications. One such standard, ASTM Method E 152, requires a door to maintain its integrity for twenty minutes while withstanding progressively increasing temperatures reaching a maximum of 1462° F. The fire door of the present invention meets the requirement of this test.

Considerations in fire door design in addition to retarding the advance of a fire, include the cost of raw materials and the cost of fabrication. Furthermore, the weight of the door is important both from the standpoint of ease in handling and the cost of transportation. The strength of the door is also an significant factor since fire doors must pass water stream tests as well as have the requisite structural strength to withstand normal use and abuse.

Fire-resistant doors have been made in a variety of constructions utilizing a number of materials including wood, metal and mineral materials. Early forms of fire doors comprised simply wooden cores faced with metal sheeting. Although wood of ample thickness is an effective fire and heat retardant, the doors of such construction tended to be heavy, and were expensive to fabricate and transport.

Mineral materials have also been employed in the manufacture of fire doors. The core of a commercially-available metal fire door principally comprises a composition including mineral fibers and a binder. Such doors suffer, however, from a lack of strength and the handling of the cores, which are friable, results in the production of irritating dust particles during the manufacture process.

It has also been proposed to make fire doors wherein the core comprises particles of expanded perlite which are bound together by the use of various hydraulic binders including gypsum, cement and inorganic adhesive material. In order to provide sufficient strength, particularly to withstand handling of the core during manufacture, the core is compressed to compact the mixture to a relatively high density, resulting in a relatively heavy door weight.

Other fire door proposals have included the use of conventional gypsum wallboard panels as a core material. However, in order to provide sufficient fire resistance, the thickness required of the wallboard is such as to result in an excessively heavy door. Furthermore, internal structural members such as rails or mullions have been found necessary to support and strengthen wallboard panels. The need for such reinforcing elements increases the cost of materials and assembly of such doors, and, by dividing the core into sections, results in internal seams in the door core structure through which flame and smoke can penetrate under fire conditions.

SUMMARY OF THE INVENTION

The present fire-resistant door is of a laminated construction comprising a spaced pair of door facing sheets bonded to a wooden edge banding assembly and between which is disposed a single gypsum wallboard core panel having a fiber mat at least partially embedded in each face thereof. The fiber mat preferably comprises glass fibers and is embedded into the gypsum board during the manufacture of the board. In the preferred embodiment of the invention, the wallboard has a thickness of less than about 0.5" and the space between the wallboard and the facing sheets is at least partially filled with a light weight spacer material such as a rigid plastic foam, honeycomb cardboard or the like. The spacer material may fill all of the space between the facing sheets and the wallboard core or may comprise discrete spacer elements located so as to provide appropriate stiffening of the facing sheets.

It is accordingly a primary object of the present invention to provide a fire-resistant door construction which utilizes a mineral material and specifically gypsum wallboard as the fire-resistant core material.

A further object of the invention is to provide a fire-resistant door as described having sufficient fire and heat retarding capabilities to pass fire test requirements and sufficient structural strength to pass hose stream test requirements.

Another object of the invention is to provide a fire-resistant door construction as described which is formed from lightweight, inexpensive materials, and which can be manufactured in a simple and inexpensive process.

Still another object of the invention is to provide a fire-resistant door construction as described which is readily adaptable for use in the manufacture of either flush doors or doors having decorative face configurations such as quarter panel doors.

Additional objects and advantages of the present invention will be readily apparent from the following detailed description of embodiments thereof taken together with the accompanying drawings.

DESCRIPTION OF THE PREFERRED EMBODIMENTS

Figure 1:
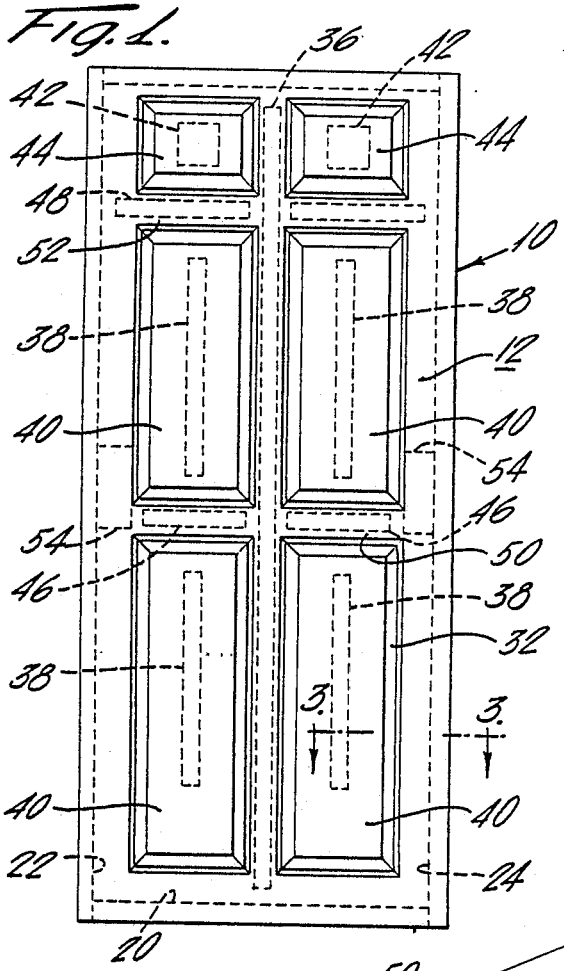
FIG. 1 is a front elevational view of a fire-resistant quarter panel door in accordance with the present invention.
Figure 2:
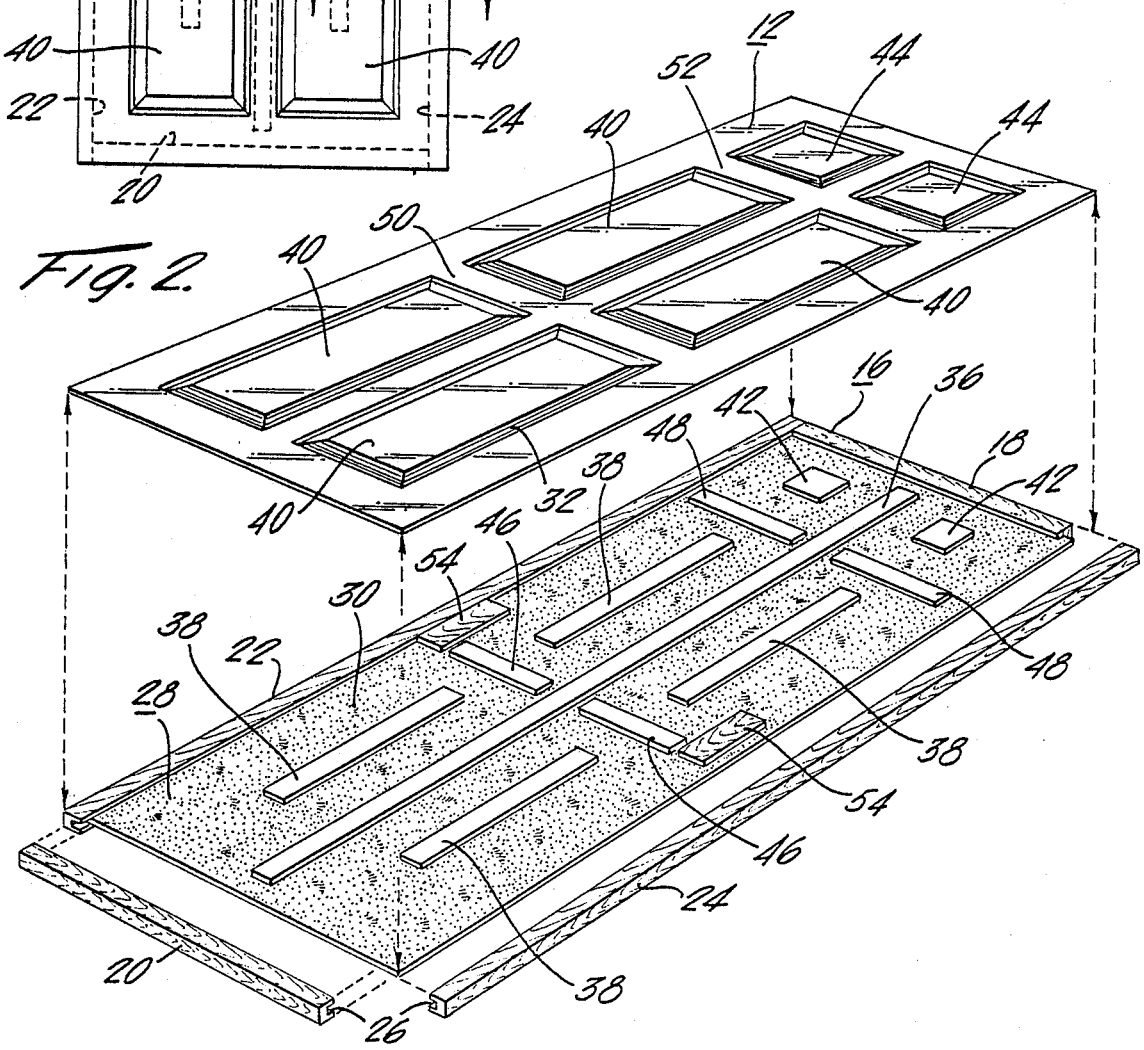
FIG. 2 is an exploded perspective view of a portion of the door of FIG. 1.
Figure 3:
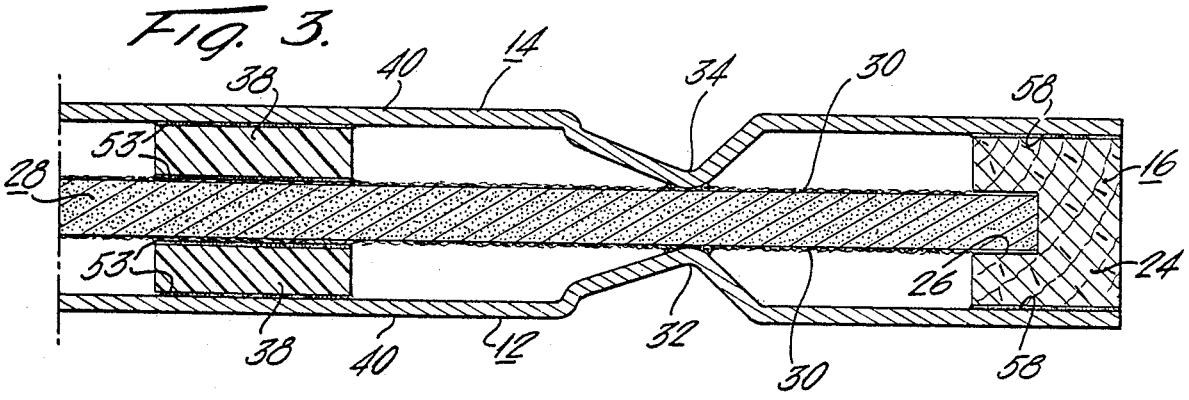
FIG. 3 is an enlarged sectional view taken along line 3—3 of FIG. 1.

Referring to the drawings and particularly FIGS. 1–3 thereof, a fire-resistant door generally designated 10 in accordance with the present invention is illustrated and includes a pair of parallel opposed hardboard facing sheets 12 and 14 which along their edges are adhesively bonded to opposite sides of a rectangular wooden edge banding assembly 16. As shown in FIG. 2, the edge banding assembly comprises top and bottom rail portions 18 and 20 and connecting stile portions 22 and 24. A continuous groove 26 is cut into the inner edge of the edge banding members 18, 20, 22 and 24.

The door 10 includes a fire-resistant core comprising a gypsum wallboard panel 28 which is centrally disposed in spaced relation between the door faces 12 and 14 with its edges extending into the groove 26 of the edge banding members in close fitting relation therewith. Inasmuch as the gypsum wallboard core 28 is held captive within the edge banding by the groove 26, there is no need for adhesives or fasteners to secure the wallboard edges within the groove 26.

As discussed in more detail herebelow, the wallboard 28 is of a conventional gypsum wallboard formulation such as is widely used in interior partitioning for residential and commercial structures. However, the wallboard 28 differs from the conventional paper faced gypsum wallboard in that each face of the present board includes a fiber mat 30 which is at least partially embedded into the gypsum slurry at the time of manufacture of the board. The mat 30, which preferably comprises a glass fiber mat, adds structural strength to the wallboard core and enables the use of relatively thin wallboard sheets, typically less than about 0.5" and preferably about 0.42", with an adequate amount of fire-resistance and strength to meet fire and water stream test standards as well as to withstand the abuse to which doors are subjected in their normal usage.

In the embodiment of FIGS. 1–3, the facing sheets 12 and 14 have an ornamental configuration, particularly that of a quarter panel door which includes four large panels 40 and two smaller panels 44. Other ornamental configurations may be chosen and, as described in the additionally illustrated embodiments, a flush door facing sheet may also be utilized with a door in accordance with the invention. As shown in FIG. 3, the configuring of the panels 12 and 14 to present the inpression of a paneled door produces the respective inwardly directed deformations 32 and 34 in the otherwise planar facing sheets, the inner edges of which deformations engage the glass-fiber matfaced gypsum core panel 28.

A spacer material is provided in the door 10 at least partially filling the spaces between the facing sheets 12 and 14 and the core panel 28. In the embodiment of FIGS. 1–3, the spacer material comprises a plurality of spacer elements formed from a rigid plastic foam such as expanded polystyrene. These spacer elements, which are of a similar width but of a length dictated by the configuration of the facing sheets, include a central elongated element 36, shorter parallel elements 38 centrally disposed beneath the larger panels 40 of the facing sheet, and small spacer elements 42 disposed beneath the smaller panels 44 of the facing sheet. In addition, spacer elements 46 and 48 are respectively disposed beneath the intermediate rail portions 50 and 52 of the door facing sheet. As described herebelow and as shown at 53 in FIG. 3, these spacer elements are adhesively bonded to the core panel 28 and the facing sheets during the assembly of the door.

Wooden spacer blocks 54 as shown in FIG. 2 are also adhesively interposed between the panel 28 and the facing sheets in the region wherein the door hardware such as handles and locks are to be placed to provide sufficient structure in this region for the proper mounting of the hardware.

The assembly of the door components is straightforward and can be quickly accomplished without skilled labor or elaborate equipment. A first facing sheet is placed outerface down on the assembly surface and the spacer material elements 36, 48 42, 46 and 48 and the blocks 54 are adhesively affixed to the inner surface of the facing sheet in predetermined positions, such as those illustrated in FIG. 2. The edge banding assembly 16 is then placed onto the edges of the wallboard core panel 28, and the faces of the edge banding are coated with adhesive as shown at 58 in FIGS. 3. The assembled core panel and edge banding is then placed onto the facing sheet with affixed spacer elements.

The assembly continues with the adhesive application of the second set of spacer material elements 36, 38, 42, 46 and 48 and blocks 54 to the upper surface of the core panel. The assembly is completed by the application of the second facing sheet onto the edge banding, spacers and blocks, all of which have been coated with adhesive. The assembled door elements are then put in a press for a suitable period to allow for the setting of the adhesive. Utilizing a casein glue for this purpose, the clamping of the door components for approximately one hour normally provides an adequate setting of the glue. If desired, the elements can be stapled together temporarily after assembly to hold the elements in the proper alignment during transfer to the press.

Figure 4:
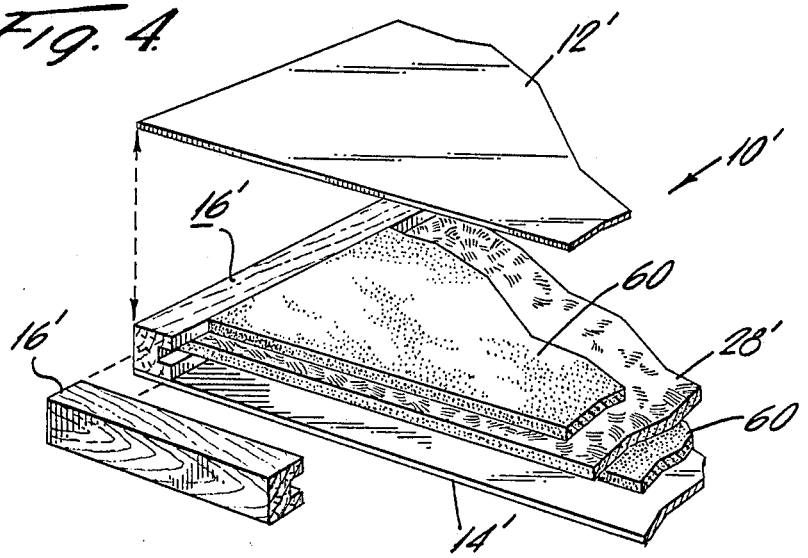
FIG. 4 is a partial exploded perspective view of a modified embodiment of the invention.

In the modified embodiment of FIG. 4, the door 10' comprises a fiber mat faced core panel 28' and edge banding assembly 16' which are identical with those members of the embodiment of FIGS. 1–3. The facing sheets 12' and 14' however are flat sheets devoid of ornamentation and thus produce what is known as a flush door. The facing sheets 12' and 14' are adhesively bonded to the edge banding as in the previous embodiment. The spacer material in the embodiment of FIG. 4 comprises single sheets 60 of a lightweight plastic foam such as expanded polystyrene which are coated with adhesive on both sides to effectively bond the facing sheets 12' and 14' to the core panel 28'. The assembly of the flush door is essentially the same as that described for the quarter panel door but is simpler since only a single sheet of spacer material is needed on each side of the core panel. Wooden spacer blocks (not shown) are desirably included in place of the spacer material at locations where door hardware is to be mounted.

Figure 5:
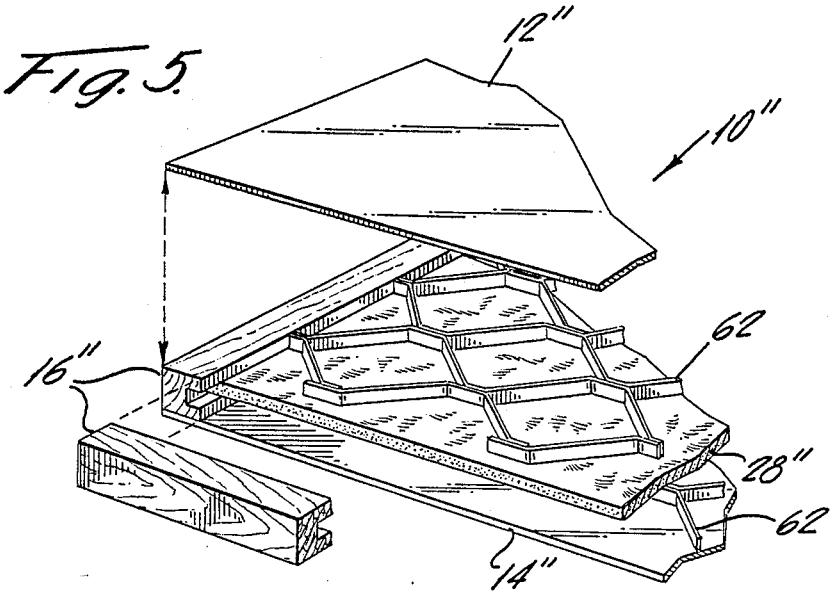
FIG. 5 is a partial exploded perspective view of another modified embodiment of the invention.

The embodiment of FIG. 5 is identical with FIG. 4 with the exception that cardboard honeycomb spacer elements 62 are substituted for the plastic foam spacer sheets 60 of the previously described embodiment. In the embodiment of FIG. 5, the door 10" includes a fiber mat faced core panel 28" disposed within a grooved edge banding assembly 16". Planar facing sheets 12" and 14" are adhesively affixed to the faces of the edge banding assembly 16". The cardboard honeycomb spacer elements 62 are disposed on both sides of the core panel 28" and are adhesively bonded on both faces to the core panel 28" and the respective facing sheets 12" and 14". Assembly is substantially the same as with the previous embodiments. Wooden spacer blocks (not shown) are desirably included in place of the spacer material in areas in which door hardware is to be mounted.

The facing sheets 12 and 14 are preferably made of thin hardboard having a thickness of approximately one eight inch. Other thin sheet materials could also be employed for these members, such as metal, or fiber reinforced plastics.

The edge banding material is most suitably a relatively low density wood having stable dimensional characteristics such as pine or fir. The outer edges of the stiles, which are visible, should be free of knots and other imperfections although this is not important with respect to the rails which are not visible when the door is hung.

A fiber mat faced gypsum board similar to that preferred for the present invention is disclosed in U.S. Pat. No. 4,647,496, issued Mar. 3, 1987 and assigned with the present application to a common assignee. This patent, which is hereby incorporated by reference, fully discloses the composition and construction of a glass fiber mat-faced gypsum board and in addition describes the process for making such a board.

Other fibrous mat-faced gypsum boards and methods for making the same are described in U.S. Pat. No. 3,993,822 and Canadian Pat. No. 993,779.

The preferred fibrous mat is a glass fiber mat comprising glass fiber filaments oriented in random pattern and bound together with a resin binder. Glass fiber mats of this type are commercially available, for example, those sold under the trademark DURA-GLASS by Manville Building Materials Corporation and those sold by ELK Corporation as BUR or shingle mat.

As described in the above-mentioned U.S. Pat. No. 4,647,496, the fiber mat should be sufficiently porous to permit water in the aqueous gypsum slurry from which the gypsum core is made to evaporate therethrough. As further described in the patent, the gypsum panel can be made efficiently by forming an aqueous gypsum slurry which contains excess water and which is placed on the fibrous mat. Aided by heating, excess water evaporates through the porous mat as the calcined gypsum sets.

EXAMPLE

A preferred aqueous gypsum slurry which can be used in making the gypsum wallboard core panel for use in the present invention has the following formulation expressed in lbs. per 1000 sq. ft. of board: calcined gypsum ($CaSO \cdot \frac{1}{2}H_2O$), 1380 lbs; and water, 260 lbs. The fiber mat of the example is a commercially available Manville product having the product designation DURA-GLASS 7590. This product comprises a nonwoven mat composed of glass fiber filaments arranged in a random pattern and bonded together with a resin binder. The mat has a weight, expressed in pounds per square feet of 18.5 min., 20 avg, and 21.5 max. The mat has a caliper in mils. of 28 min., 34 avg. and 40 max. The tensile strength is 60 lbs. for a 3" wide strip. The wallboard core panel of the example has a thickness of 0.42" with a tolerance of ±0.015". The density of the core panel is in the range of 42–45 lbs. per cubic foot.

Depending on the viscosity of the slurry and other factors in the manufacturing process, the fiber mat can be partially or completely embedded in the faces of the panel. For use as the core panel of a fire-resistant door, it does not appear important as to whether the fiber mat is partly or completely embedded in the gypsum surface as long as a strong bond is formed with the set gypsum.

Although as mentioned glass fibers are the preferred fibers for use in the mat facing, other fibers such as synthetic resin fibers may be suitably used. Furthermore, the mat could comprise continuous or discrete strands of fibers and be woven or nonwoven in form.

A significant advantage of the invention is the light weight of the fiber mat gypsum wallboard core. The use of a glass fiber mat in place of the conventional paper facing on the gypsum board in itself produces a significant weight saving. The weight of a widely used paper facing in the manufacture of conventional gypsum wallboard is in the range of about 120 lbs/100 sq. ft. of board, whereas the weight of a preferred form of glass fiber mat for use in the present invention is about 40 lbs/1000 sq. ft. of board.

In the preferred form of the invention, the core of the fiber mat-faced gypsum board has a density of about 40 to about 50 lbs/cu.ft., preferably about 42 to about 45 lbs/cu.ft. The manufacture of cores having densities within the preferred range can be effected by using known techniques, for example, by introducing an appropriate amount of foam into the aqueous gypsum slurry from which the core is formed.

Manifestly, changes in details of construction can be effected by those skilled in the art without departing from the invention.

We claim:

1. A fire-resistant door comprising:

a core panel of mineral material, said core panel including a fiber mat coextensive with and at least partially embedded in each face of said panel, an edge banding assembly disposed around the periphery of said core panel, a door facing sheet affixed to each side of said edge banding assembly in spaced parallel relation to said core panel, and a spacer material at least partially filling the spaces between said facing sheets and said core panel.

2. The invention as claimed in claim 1, wherein said core panel is less than about 0.5" thick.

3. The invention as claimed in claim 1, wherein said fiber mat comprises a glass fiber mat.

4. The invention as claimed in claim 1, wherein said edge banding assembly is centrally grooved around its internal edges to receive the edges of said core panel within said groove.

5. The invention as claimed in claim 1, wherein said edge banding assembly comprises a rectangular frame of wooden elements.

6. The invention as claimed in claim 1, wherein said facing sheets are adhesively affixed to said edge banding assembly.

7. The invention as claimed in claim 1, wherein said facing sheets are formed of hardboard.

8. The invention as claimed in claim 1, wherein said facing sheets are decoratively configured to simulate a quarter panel door face.

9. The invention as claimed in claim 1, wherein said facing sheets are planar sheets.

10. The invention as claimed in claim 1, wherein said spacer material comprises a rigid plastic foam.

11. The invention as claimed in claim 1, wherein said spacer material comprises a honeycomb cardboard material.

12. The invention as claimed in claim 1, wherein said core panel comprises a single panel of gypsum wallboard.

13. The invention as claimed in claim 12, wherein said core panel has a density of about 40 to about 50 lbs/cu.ft.

14. A fire-resistant door comprising:

a core panel of gypsum wallboard material, said core panel including a glass fiber mat coextensive with and at least partially embedded in each face of said panel, an edge banding assembly comprising a rectangular frame of wooden elements disposed around the periphery of said core panel, said edge banding assembly elements being centrally grooved around their internal edges to receive the edges of said core panel within said groove, a door facing sheet adhesively affixed to each side of said edge banding assembly in spaced parallel relation to said core panel, and a spacer material at least partially filling the spaces between said facing sheets and said core panel.

15. The invention as claimed in claim 14, wherein said core panel has a density of about 40 to about 50 lbs/cu.ft.

16. The invention as claimed in claim 14, wherein said core panel has a density of about 42 to about 45/lbs/cu.ft.

17. The invention as claimed in claim 14, wherein said core panel is less than about 0.5" thick.

18. The invention as claimed in claim 14, wherein said facing sheets are formed of hardboard.

19. The invention as claimed in claim 14, wherein said facing sheets are decoratively configured to simulate a quarter panel door face.

20. The invention as claimed in claim 14, wherein said facing sheets are planar sheets.

21. The invention as claimed in claim 14, wherein said spacer material comprises a rigid plastic foam.

22. The invention as claimed in claim 14, wherein said spacer material comprises a honeycomb cardboard material.

23. The invention as claimed in claim 14, wherein said spacer material is adhesively bonded to said facing sheets and said core panel.

* * * * *